US006422212B1

(12) United States Patent
Faix et al.

(10) Patent No.: US 6,422,212 B1
(45) Date of Patent: Jul. 23, 2002

(54) ON-OFF VALVE IN A FUEL INJECTION SYSTEM FOR INTERNAL COMBUSTION ENGINES

(75) Inventors: Erhard Faix, Gaertringen; Helmut Clauss, Eberdingen; Rainer Lorenz, Korntal-Muenchingen; Gerd Loesch; Markus Rueckle, both of Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/674,003

(22) PCT Filed: Dec. 10, 1998

(86) PCT No.: PCT/DE98/03628

§ 371 (c)(1),
(2), (4) Date: Mar. 12, 2001

(87) PCT Pub. No.: WO99/56016

PCT Pub. Date: Nov. 4, 1999

(30) Foreign Application Priority Data

Apr. 24, 1998 (DE) ..... 198 18 385

(51) Int. Cl.[7] ..... F02M 37/04

(52) U.S. Cl. ..... 123/506; 123/510; 137/533.11; 137/539

(58) Field of Search ..... 123/446, 456, 123/506, 507, 508, 510, 514; 137/533.11, 539, 543.19, 543.23, 514.7

(56) References Cited

U.S. PATENT DOCUMENTS 2,742,054 A * 4/1956 Poundstone ..... 137/522
5,911,208 A * 6/1999 Furusawa et al. ..... 123/456
5,937,896 A * 8/1999 Miyajima et al. ..... 137/533.11
6,058,912 A * 5/2000 Rembold et al. ..... 123/179.17
6,065,436 A * 5/2000 Koga et al. ..... 123/179.17
6,135,090 A * 10/2000 Kawachi et al. ..... 123/446
6,196,191 B1 * 3/2001 Rembold et al. ..... 123/447
6,209,525 B1 * 4/2001 Konishi et al. ..... 123/458
6,209,527 B1 * 4/2001 Bueser et al. ..... 123/506
6,257,204 B1 * 7/2001 Kamijo et al. ..... 123/179.17
6,336,445 B1 * 1/2002 Yamazaki et al. ..... 123/456
6,345,608 B1 * 2/2002 Rembold et al. ..... 123/456

FOREIGN PATENT DOCUMENTS

JP 176619 * 6/1998 ..... F02M/37/00
JP 265926 * 9/2000 ..... F02M/37/06

* cited by examiner

*Primary Examiner*—Tony M. Argenbright
*Assistant Examiner*—Hai Huynh
(74) *Attorney, Agent, or Firm*—Ronald E. Greigg

(57) ABSTRACT

A fuel injection system has a low-pressure pump for withdrawing fuel from a tank and a high-pressure pump, which is supplied by the low-pressure pump and has camshaft-actuated pump elements. An on-off valve is connected on the inlet side to the pressure side of the low-pressure pump and on the outlet side, is connected on the one hand to a camshaft chamber of the high-pressure pump and on the other hand, is connected to the suction side of the low-pressure pump. At a first pressure threshold, a spring-loaded valve piston of the on-off valve opens a connection between the low-pressure pump and the camshaft chamber and at a relatively higher second pressure threshold, opens a connection between the pressure side and the suction side of the low-pressure pump. A throttle bore in the bottom of the valve piston serves to ventilate the low-pressure system.

5 Claims, 1 Drawing Sheet

ON-OFF VALVE IN A FUEL INJECTION SYSTEM FOR INTERNAL COMBUSTION ENGINES

CROSS-REFERENCE TO RELATED APPLICATION

This is a 35 USC 371 application of PCT/DE 98/03628 filed on Dec. 10, 1998.

BACKGROUND OF THE INVENTION

This invention is directed to an on-off valve and more particularly to an on-off valve especially useful in a fuel injection system for an internal combustion engine.

DESCRIPTION OF THE PRIOR ART

A known fuel injection system for internal combustion engines is is disclosed in DE 44 01 074 A1. This system has a low-pressure pump that aspirates fuel from a tank and delivers it to a high-pressure pump. An on-off valve with a compression spring-loaded sleeve-shaped valve piston is disposed in the connecting line between the two pumps. This valve piston has a throttle bore in its bottom, via which the low-pressure pump continuously communicates with a camshaft chamber of the high-pressure pump, which is embodied as a radial piston pump. The camshaft chamber is in turn connected to the fuel tank.

In this system, the valve piston can be moved by the pressure of the fuel delivered by the low-pressure pump counter to the force of the compression spring. When a pressure threshold is exceeded, the valve piston opens a line connection to pump elements of the high-pressure pump.

The on-off valve has several functions: on the one hand, the low-pressure part of the fuel injection system can be ventilated on the way via the throttle bore and the camshaft chamber. On the other hand, fuel serving as a lubricant is supplied to the camshaft chamber via the throttle bore. Moreover, in the event of a defect in the high-pressure part of the system, the on-off valve is intended to function as a shut-off valve in order to protect the engine. With this known embodiment, however, it is disadvantageous that the fuel flow not withdrawn by the high-pressure pump results in an uneconomical operation of the low-pressure pump.

SUMMARY OF THE INVENTION

The on-off valve according to the invention, has the advantage over the above prior art valve that outside the direct line connection between the low-pressure pump and the high-pressure pump, in addition to the ventilation of the low-pressure part of the fuel injection system and the dimensioning of the lubricant flow to camshaft of the high-pressure pump, it also assures that the fuel volume flow not withdrawn by the high-pressure pump is diverted directly to the suction side of the low-pressure pump. In so doing, the on-off valve controls two fuel circuits, namely the circuit used to lubricate and cool the high-pressure pump and the circuit used to return the diverted fuel, wherein the first circuit remains largely uninfluenced when the second circuit is switched on. Moreover, the return of the diverted fuel directly to the suction side of the low-pressure pump increases the delivery capacity of this pump since a preliminary filter of the system required for filtering the fuel can be bypassed.

The valve of the present invention is advantageous because several valve functions can be performed by a single movable valve member. In addition, the valve can be completely preassembled and tested as a standard component. Due to its disposition in the housing of the high-pressure pump, the installation of the valve into the system involves little expense, in particular, only one seal in relation to the outside is required since the screw thread hydraulically separates the connections of the pump housing to the camshaft chamber and the suction side of the low-pressure pump from each other to a sufficient degree. As a result, the on-off valve can be produced with a relatively short valve housing.

BRIEF DESCRIPTION OF THE DRAWINGS

Other advantages of the improved on-off valve will be apparent from the detailed description contained below, taken with the drawings, in which.

DESCRIPTION OF THE PREFERRED EMBODIMENT

Figure 1:
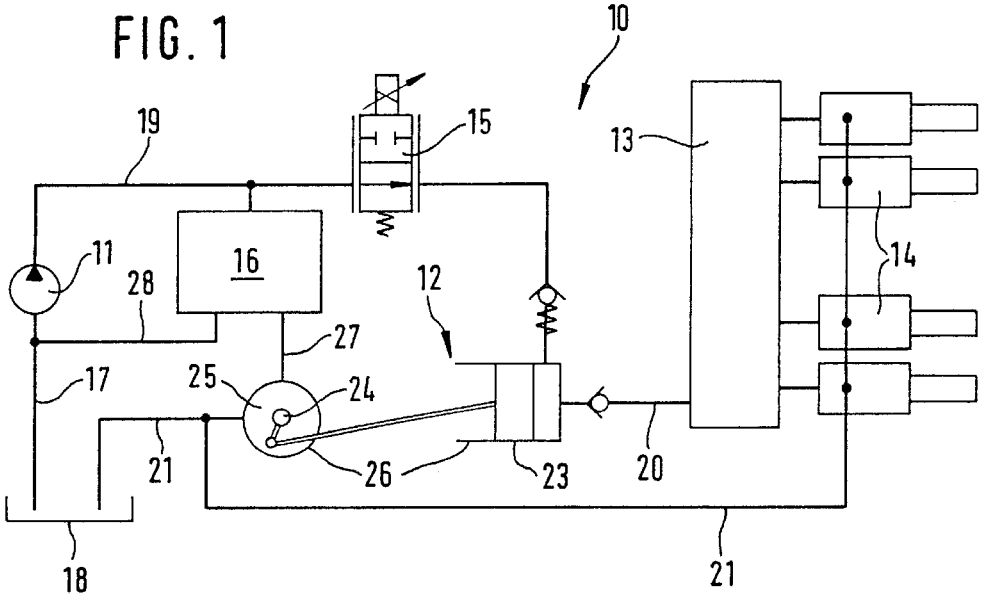
FIG. 1 is a hydraulic connection diagram of a schematically depicted fuel injection system with an on-off valve associated with a high-pressure pump and FIG. 2 is a longitudinal section through the on-off valve.

A fuel accumulator injection system 10 for internal combustion engines, i.e. direct-injecting diesel engines, which is shown in a highly simplified form in FIG. 1, contains the following essential elements: a low-pressure pump 11, a high-pressure pump 12, a high-pressure fuel accumulator or common rail 13, injection solenoid valves (injectors) 14, a quantity regulating valve 15, and an on-off valve 16. The low-pressure pump 11 is connected with a suction line 17 to a fuel container or tank 18 and with a low-pressure line 19 to the high-pressure pump 12. The quantity regulating valve 15 is disposed in the low-pressure line 19. The high-pressure pump 12 that is supplied by the low-pressure pump 11 is in turn connected on its outlet side by means of a high-pressure line 20 with the high-pressure fuel accumulator 13, which is connected to the injection solenoid valves 14, and a tank outlet line 21 leads from valves 14 to the fuel tank 18. The operation of the fuel accumulator injection system 10 is known so that the discussion below involves only the disposition of the on-off valve 16 in the system, as well as the design and function of the on-off valve 16.

The high-pressure pump 12 is embodied in the structural form of a radial piston pump with a number of pump elements 23, only one of which is shown in FIG. 1. A camshaft 24 (or an eccentric shaft or crankshaft) is used to drive the pump elements 23. The camshaft 24 is disposed in a camshaft chamber 25 of a pump housing 26. From the on-off valve 16, which is connected on the inlet side to the low-pressure line 19, a supply line 27 leads into the camshaft chamber 25 and a return line 28 leads to the suction line 17 of the low-pressure pump 11. The camshaft chamber 25 is in turn connected on the outlet side to the tank outlet line 21.

Figure 2:
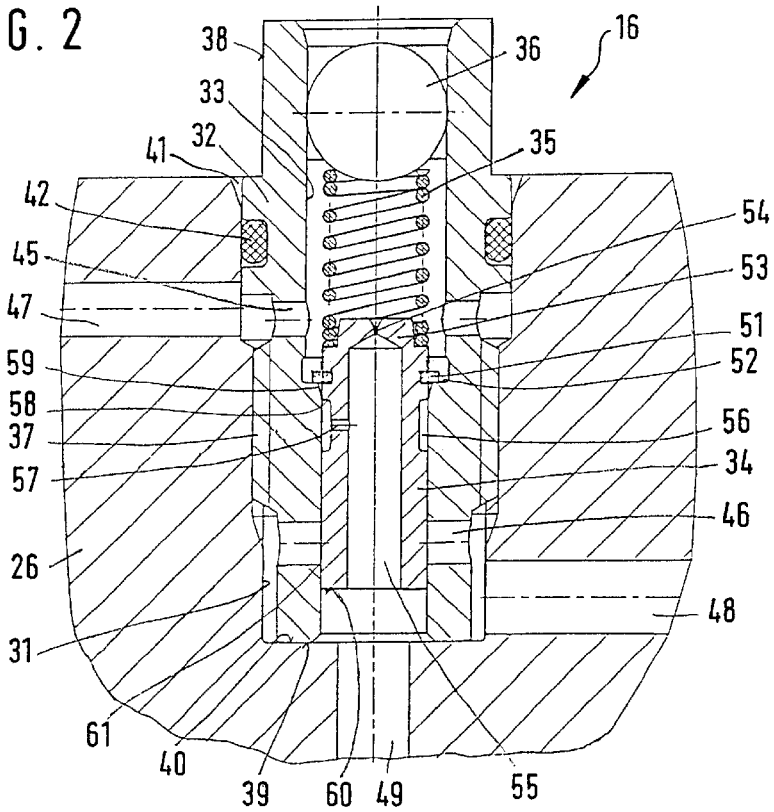

The exemplary embodiment of the on-off valve 16 shown in FIG. 2 employs a valve housing 32, which is embodied as a hollow cylindrical screwed part and is predominantly enclosed in a blind hole bore 31 of the pump housing 26 of the high-pressure pump 25, and the stepped through bore 33 of this valve housing 32 contains a longitudinally movable valve piston 34, a helical compression spring 35 disposed in coaxial series with this valve piston, and a ball 36 that seals the through bore 33 in a pressure-tight manner in relation to the outside. The valve housing 32 has an externally threaded section 37 with which it is screwed into the blind hole bore 31 through the engagement of a nut 38 disposed on the valve housing. In the position of the valve housing 32 shown, its end face 39 disposed at the bottom in the drawing engages with the bore bottom 40 of the blind hole bore 31. At the mouth end 41 of the blind hole bore 31, the valve housing 32 is sealed with a sealing ring 42.

Between the sealing ring 42 and the bore bottom 40, the valve housing 32 is provided with two transverse bores 45 and 46 that cross the through bore 33. The transverse bore 45 oriented nearest the sealing ring communicates with a first outlet bore 47 of the pump housing 26. The first outlet bore 47 is part of the supply line 27 to the camshaft chamber 25 of the high-pressure pump 12 (see FIG. 1). The second transverse bore 46 of the valve housing 32 remote from the sealing ring communicates with a second outlet bore 48 of the pump housing 26. The second outlet bore 48 is part of the return line 28 leading to the suction side of the low-pressure pump 11. At the end of the valve housing 32, an inlet bore 49 is connected to the through bore 33. The inlet bore 49 is connected to the low-pressure line 19 leading from the low-pressure pump 11 to the high-pressure pump 12. Due to the sealed engagement of the valve housing 32 with the bore bottom 40, the second outlet bore 48 is completely separated from the inlet bore 49. A sufficient hydraulic seal is produced between the first outlet bore 47 and the second outlet bore 48 by means of the screw connection (externally threaded section 37) between the valve housing 32 and the pump housing 26.

The sleeve-shaped valve piston 34 is snugly contained in the through bore 33 of the valve housing 32. In the rest position of the on-off valve 16, the valve piston 34 is supported with a snap ring 51 disposed on its circumference against a step 52 of the through bore 33 as a result of the spring force of the helical compression spring 35 engaging the valve piston. Its initial tension is adjusted by a correspondingly deep press-fitting of the ball 36 into the through bore 33. In its piston bottom 53 oriented toward the spring, the valve piston 34 has a throttle bore 54 which connects the section of the through bore 33 oriented toward the spring to the inner chamber 55 of the valve piston 34. On the circumference side, the valve piston 34 has an annular groove 56 which communicates with the internal chamber 55 by means of one or a number of throttle bores 57. The annular groove 56 of the valve piston 34 constitutes a first control edge 58, which is associated with a hollow, conical first control contour 59 of the valve housing 32 on the step 52 of the through bore 33. On its end remote from the spring, the valve piston 54 has a second control edge 60, which cooperates with the transverse bore 46 of the valve housing 32 that constitutes a second control contour 61.

In the depicted rest position of the on-off valve 16, the valve piston 34 closes the connection from the inlet bore 49 through the throttle bore 57 to the first outlet bore 47 as well as from the inlet bore 49 to the second outlet bore 48.

The inlet bore 49, however, continuously communicates with the camshaft chamber 25 of the high-pressure pump 12 by means of the throttle bore 54 in the piston bottom 53. When the low-pressure pump 11 is started up, air disposed in the low-pressure system can flow out through the throttle bore 54 in the piston bottom 56 of the valve piston 34, through the first outlet bore 47, into the camshaft chamber 25 and from this, can flow out through the tank outlet line 21. This effectively achieves a ventilation of the low-pressure system.

With increasing delivery pressure of the fuel that the low-pressure pump 11 withdraws from the tank 18 and supplies to the on-off valve 16 by means of the inlet bore 49, the valve piston 34 is moved out of its rest position counter to the spring force of the compression spring 35. When a first pressure threshold is exceeded, the first control edge 58 of the valve piston 34 arrives in the vicinity of the control contour 59 so that a fuel flow can travel from the inlet bore 49, through the throttle bore 57 of the valve piston 34, to the first outlet bore 47, and on into the camshaft chamber 25 of the high-pressure pump 12. With a small stroke of the valve piston 34, the on-off valve 16 functions as a flow regulating valve which adjusts a fuel volume flow that is sufficient for lubricating and cooling the high-pressure pump 12. This is supplemented by the partial fuel quantity traveling through the throttle bore 54 in the piston bottom 53 that extends parallel to the throttle bore 57.

With further increasing delivery pressure of the low-pressure pump 11, when a second pressure threshold is exceeded, which is higher than the first pressure threshold, the valve piston 34, which is longitudinally moved in the direction of the ball 36, unblocks the lateral bore 46 of the valve housing 32 with its second control edge 60. Fuel that is not withdrawn by the high-pressure pump 12 is diverted directly to the suction side of the low-pressure pump 11 through the second outlet bore 48 and the return line 28. The on-off valve 16 now also functions as a pressure regulating valve which keeps the inlet side pressure largely free of fluctuations. The pressure regulation has an advantageous effect on the quantity regulating valve 15 because having a fuel that is low in pressure fluctuations supplied to this valve supports the functioning of the valve.

The foregoing relates to preferred exemplary embodiments of the invention, it being understood that other variant and embodiments thereof are possible within the spirit and scope of the invention, the latter being defined by the appended claims.

We claim:

1. In an on-off valve (16) for use in a fuel injection system (10) for internal combustion engines, the system housing a low-pressure pump (11) for withdrawing fuel from a tank (18) and a high-pressure pump (12) that is supplied by the low-pressure pump (11) and camshaft-actuated pump elements (23), wherein the on-off valve (16) has a sleeve-shaped valve piston (34), which can be longitudinally moved by the pressure of the low-pressure pump (11) and is loaded by a prestressed helical compression spring (35), has a throttle bore (54) in the piston bottom (53) and, at a predetermined pressure threshold of the fuel delivered by the low-pressure pump (11), opens an outlet bore (48) in a valve housing (32) that guides the piston (34), wherein the throttle bore (54), on its outlet side, continuously communicates with a chamber (25), which contains the camshaft (24) and belongs to a housing (26) of the high-pressure pump (12), which chamber is connected to the fuel tank (18), the improvement wherein, at a first pressure threshold, the valve piston (34) controls a connection (49, 55, 57, 45, 47) extending parallel to the throttle bore (54), between the low-pressure pump (11) and the camshaft chamber (25) of the high-pressure pump (12), and at a relatively higher second pressure threshold, opens the outlet bore (48) which communicates directly with the suction side of the low-pressure pump (11).

2. The valve according to claim 1, wherein, when the first pressure threshold is exceeded, the valve piston (34), in cooperation with a first control contour (59) of the valve housing (32), functions as a flow regulating valve and when the second pressure threshold is exceeded, the valve piston (34), in cooperation with a second control contour (61) of the valve housing (32), performs a pressure regulating function.

3. The valve according to claim 2, wherein the valve housing (32) is contained in the housing (26) of the high-pressure pump (12), the valve housing (32) is a hollow, cylindrical screwed part, the valve piston (34) and the compression spring (35) are contained in coaxial series in the through bore (33) of the valve, wherein the throttle bore (54) of the piston (34) is disposed oriented toward the spring, at the end remote from the spring, the through bore (33) is connected to an inlet bore (49) that communicates with the pressure side of the low-pressure pump (11), at the end oriented toward the spring, the through bore (33) is connected to the camshaft chamber (25) of the high-pressure pump (12) by means of a first transverse bore (45), and at the end remote from the spring, the through bore (33) is crossed by the second transverse bore (46), which communicates with the suction side of the low-pressure pump (11) and has the second control contour (61).

4. The valve according to claim 3, wherein, under the prestressing force of the compression spring (35), the valve piston (34) is supported against a step (52) of the through bore (33) of the valve housing (32) and the prestressing force of the compression spring (35) is adjusted with a ball (36) that is press-fitted into the through bore (33) in a pressure-tight manner.

5. The valve according to claim 3, wherein the valve housing (32) is disposed in a blind hole bore (31) and, with its end (39) engaging the bottom (40) of the blind hole bore (31), separates the inlet bore (49) from the outlet bore (48) which continues in the pump housing (26), that the valve housing (32) has an externally threaded section (37), which extends between the first transverse bore (45) and the second transverse bore (46) and which fastens it in the pump housing (26), and that between the first transverse bore (45) and the mouth (41) of the blind hole bore (31), the valve housing (32) is sealed in relation to the pump housing (26) with a sealing ring (42).

* * * * *